US010876698B2

(12) United States Patent
Mayer et al.

(10) Patent No.: US 10,876,698 B2
(45) Date of Patent: Dec. 29, 2020

(54) HEADLIGHT MODULE FOR VEHICLES

(71) Applicant: ZKW Group GMBH, Wieselburg (AT)

(72) Inventors: Matthias Mayer, Mank (AT); Stefan Miltterlehner, Mank (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 16/461,829

(22) PCT Filed: Oct. 6, 2017

(86) PCT No.: PCT/AT2017/060253
§ 371 (c)(1),
(2) Date: May 17, 2019

(87) PCT Pub. No.: WO2018/094430
PCT Pub. Date: May 31, 2018

(65) Prior Publication Data

US 2019/0360657 A1 Nov. 28, 2019

(30) Foreign Application Priority Data

Nov. 24, 2016 (AT) ..... A 51064/2016

(51) Int. Cl.
*F21S 41/675* (2018.01)
*F21S 41/275* (2018.01)
(Continued)

(52) U.S. Cl.
CPC ..... *F21S 41/36* (2018.01); *F21S 41/141* (2018.01); *F21S 41/16* (2018.01); *F21S 41/25* (2018.01)

(58) Field of Classification Search
CPC .. F21S 41/36; F21S 41/25; F21S 41/16; F21S 41/141; F21S 41/675; F21S 41/663; F21S 41/60
See application file for complete search history.

(56) References Cited

U.S. PATENT DOCUMENTS 1,888,995 A * 11/1932 Matter ..... F21V 7/0091 362/305
4,583,153 A * 4/1986 Tsuyama ..... B62J 6/00 362/517
(Continued)

FOREIGN PATENT DOCUMENTS

DE 102014213636 1/2015
DE 102015209194 11/2015
(Continued)

OTHER PUBLICATIONS

International Search Report, PCT/AT2017/060253, dated Jan. 29, 2018 (4 pages).
Office Action, AT 51064/2016, dated Jul. 27, 2017 (4 pages).

*Primary Examiner* — Arman B Fallahkhair
(74) *Attorney, Agent, or Firm* — Eversheds Sutherland (US) LLP

(57) ABSTRACT

The invention relates to a headlight module (1) for motor vehicles, comprising at least one light source (2), downstream of which at least one deflection mirror (3), a micromirror array (4) and a lens (5) are arranged in the beam path, the light emitted by the at least one light source being reflected via the deflection mirror onto the micromirror array activated by a control system, and the light pattern produced on the array being projected into the traffic space via the lens as a lighting pattern, in which module lens and mirror are formed in one piece as a lens/mirror block (10) which has a lens area (10-3) and a mirror area (10-5).

4 Claims, 4 Drawing Sheets

(51) Int. Cl.

| | |
|---|---|
| ***F21S 41/36*** | (2018.01) |
| ***F21S 41/25*** | (2018.01) |
| ***F21S 41/16*** | (2018.01) |
| ***F21S 41/141*** | (2018.01) |

(56) References Cited

U.S. PATENT DOCUMENTS

| | | | | |
|---|---|---|---|---|
| 7,712,935 | B2 * | 5/2010 | Tsukamoto | F21V 13/04 362/522 |
| 7,883,250 | B2 * | 2/2011 | Nishihata | F21S 41/336 362/516 |
| 8,622,597 | B2 * | 1/2014 | Tseng | F21S 41/147 362/517 |
| 9,581,306 | B2 | 2/2017 | Yamamura et al. | |
| 10,006,603 | B2 * | 6/2018 | De Kievit | B60Q 1/2665 |
| 10,023,102 | B2 * | 7/2018 | Mouri | F21S 41/39 |
| 10,514,158 | B2 * | 12/2019 | Fukakusa | F21V 29/507 |
| 2007/0268717 | A1 * | 11/2007 | Iwasaki | F21V 29/763 362/539 |
| 2008/0273345 | A1 | 11/2008 | Yajima et al. | |
| 2010/0321949 | A1 * | 12/2010 | Ohno | F21V 7/0091 362/538 |
| 2014/0071706 | A1 * | 3/2014 | Yagi | F21S 41/285 362/520 |

FOREIGN PATENT DOCUMENTS

| | | |
|---|---|---|
| FR | 3006744 | 12/2014 |
| JP | 2016091976 | 5/2016 |

* cited by examiner

HEADLIGHT MODULE FOR VEHICLES

The invention relates to a headlight module for motor vehicles, comprising at least one light source, downstream of which at least one deflection mirror, a micromirror array and a lens are arranged in the beam path, wherein the light emitted by the at least one light source is reflected via the deflection mirror onto the micromirror array activated by a control system, and the light pattern produced on the array is projected into the traffic space via the lens as a lighting pattern.

Headlight modules of this type are known and described in DE 10 2014 219 799 A1 or in JP 2015138763 A, for example.

When it comes to headlights, there is typically a need for very compact designs, wherein the assembly of a headlight should be simple and be carried out taking the necessary accuracy into consideration.

It is an object of the invention to create a headlight module or a headlight that meets this need.

This object is achieved by a headlight of the type mentioned at the outset in which, according to the invention, the lens and the mirror are formed in one piece as a lens/mirror block, which has a lens area and a mirror area.

Since the approach according to the invention requires fewer individual parts, this results not only in the desired simplification during assembly, in which additionally a mutual alignment of the mirror and the lens is dispensed with, but also saves material costs and labor. Another advantage of the invention is the shortened tolerance chain due to the reduced number of individual components, whereby the manufacturing process is simplified and more precise assembly of the headlight is made possible.

In a preferred embodiment, it is provided that a reflective coating is applied to the surface area of the lens/mirror block facing the at least one light source in the mirror area.

It can also be provided that at least one further lens system is arranged downstream of the lens.

Another expedient embodiment is characterized in that a diaphragm coating is applied to the surface area of the lens/mirror block facing the at least one light source in a passage area surrounding the lens area.

In many instances, it has proven to be advantageous if the surface area of the lens/mirror block facing the at least one light source is concave, and the opposing outer side is convex.

In preferred embodiments, the at least one light source comprises at least one laser diode/LED and a focusing lens arranged downstream thereof.

The invention also comprises a headlight, which comprises at least one headlight module as characterized above.

The invention, along with further advantages, will be described hereafter based on an exemplary embodiment, which is illustrated in the drawings. In the drawings.

Figure 1:
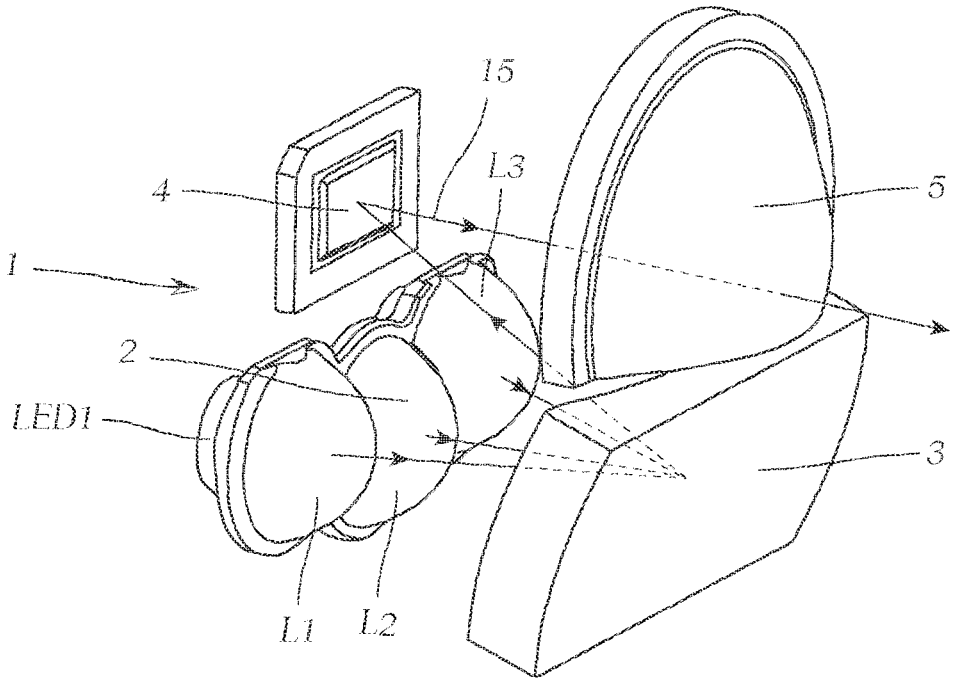
Fig. 1 (Prior Art)
FIG. 1 shows a schematic illustration of the arrangement of a light source, a deflection mirror, a micromirror array and a lens according to the prior art.

Initially referencing FIG. 1, the fundamental design of a headlight module 1 or of a headlight unit is apparent in a representation that is also greatly simplified with respect to the beam path 15. Parts required for operating the module 1, such as a power supply unit, an electronic activation unit, mounts, further optical elements and the like, have likewise been omitted in the drawing to simplify matters.

A light source 2, which is composed of three laser diodes or LED chips LED1, LED2, LED3 comprising downstream focusing lenses L1, L2, L3 here (see also FIG. 3), sends the light emitted thereby via a deflection mirror 3 onto the active surface area of a micromirror array 4. The individual micromirrors, which are intelligently activated, produce an image that is projected via a lens 5 as a lighting pattern into the traffic space located generally ahead of a motor vehicle.

Figure 2:
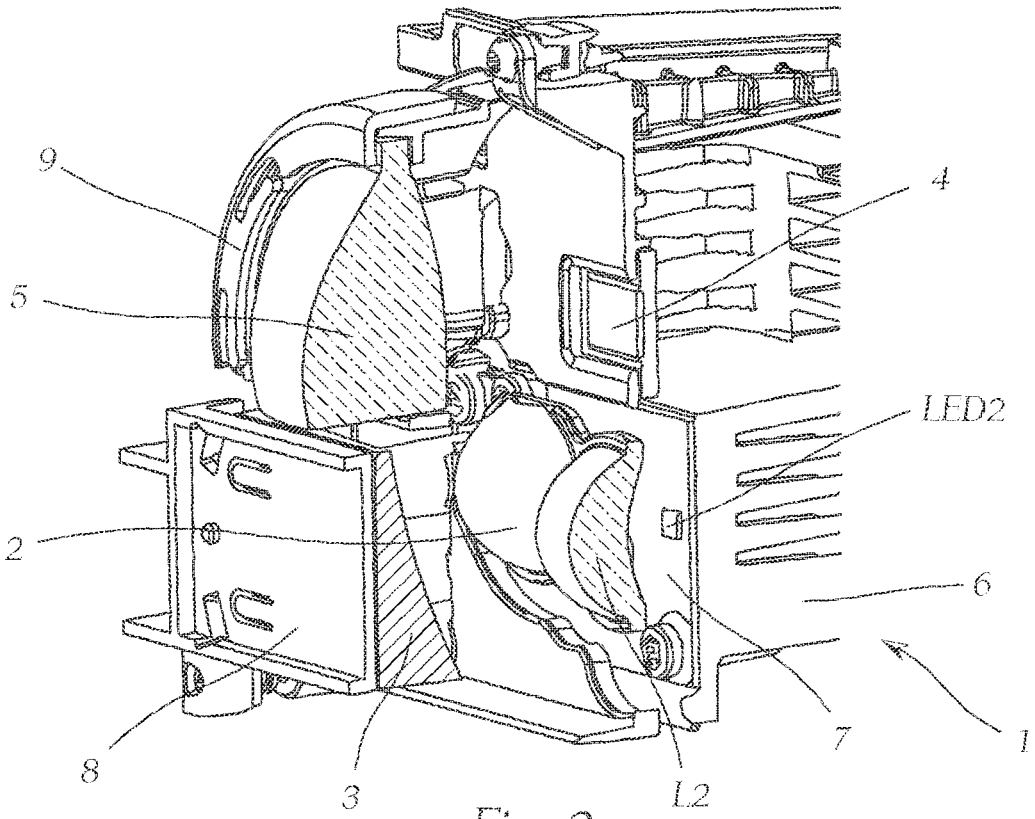
Fig. 2 (Prior Art)
FIG. 2 shows the design of a headlight module according to the representative illustration of FIG. 1 in a partially cut view.

FIG. 2 shows the basic design illustrated in FIG. 1 in an application in a conventional technical embodiment, wherein identical elements are denoted by the same reference numerals as in FIG. 1. The light source 2, which here as well can be composed of individual light sources, such as LED chips, is apparent, furthermore the mirror 3, which is located upstream thereof in the direction of radiation of the headlight module and the reflective surface of which is concavely curved here, and the micromirror array 4, which is located further toward the back and above the light source 2. The lens 5 is arranged in front of the micromirror array 4, located above the mirror 3 and designed as a biconvex vitreous body here. Moreover, a base body 6 of the module 1 is apparent, in which the micromirror array 4 and a circuit board 7 of the light sources are mounted and which ensures the necessary stability of the system and, if necessary, also ensures cooling. A dedicated mirror mount 8 is provided for the mirror 3, and the lens 5 is held in a corresponding holder 9.

Apart from the necessary number of individual parts, which also require careful alignment, the problem that usually arises is that the mirror is to be covered toward the front by an appealing design panel, while leaving the lens exposed. Since these parts, due to the desired compact design, are located closely together, design engineers and designers are often faced with problems since the cover panel often appears clunky.

Figure 3:
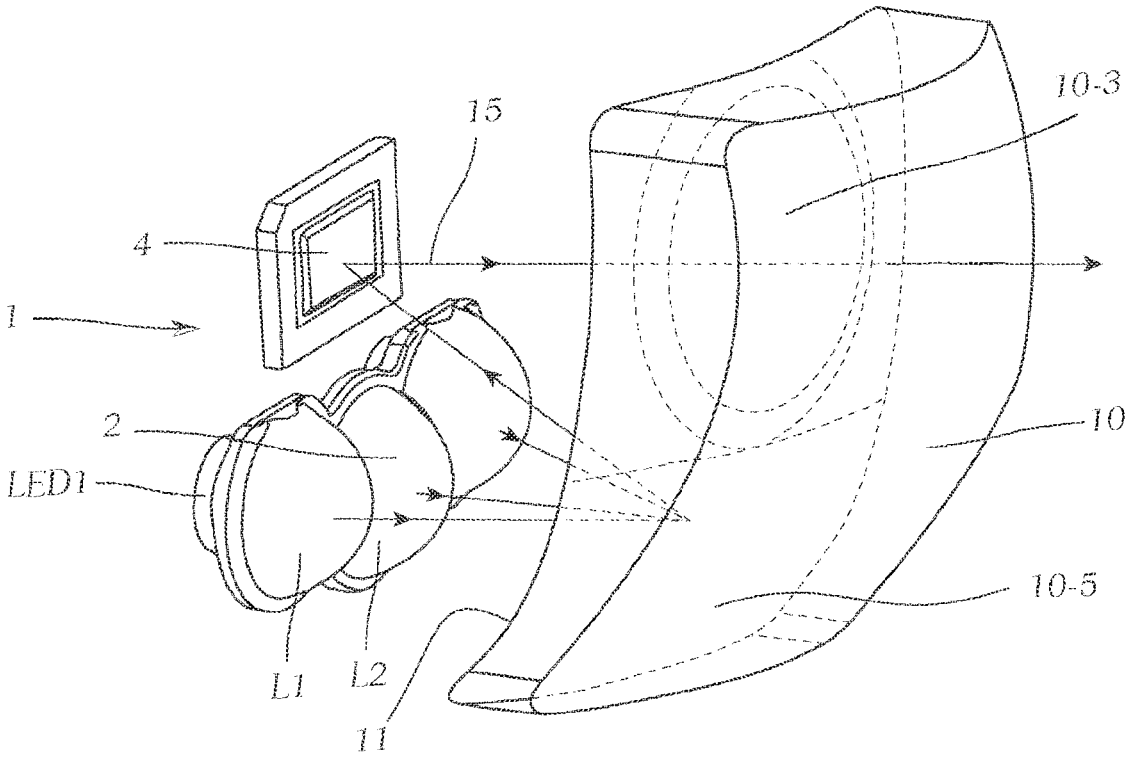
FIG. 3 shows a schematic perspective representation of the arrangement of a light source, a deflection mirror, a micromirror array and a lens according to the invention.

In contrast, FIG. 3 shows the basic design of a headlight module 1 according to the invention, wherein again the same reference numerals are used for identical or comparable parts. The essential aspect here is that the lens and the mirror are formed in one piece as a lens/mirror block 10, which has a lens area 10-3 and a mirror area 10-5. The lens/mirror block 10 is made in one piece of glass. For the sake of simplicity, the term "glass" is used, wherein this term used in the description and the claims this shall be understood to mean a material that has the optical properties of a glass within the meaning of traditional optics, but does not necessarily have to be glass in the physical sense. The lens material consequently does not have to be amorphous, but could also be crystalline or a plastic material, but in any case has to be transparent and have refractive properties. However, an optical glass in the conventional sense is preferred since it best ensures a high accuracy of the lens and heat resistance.

Figure 4:
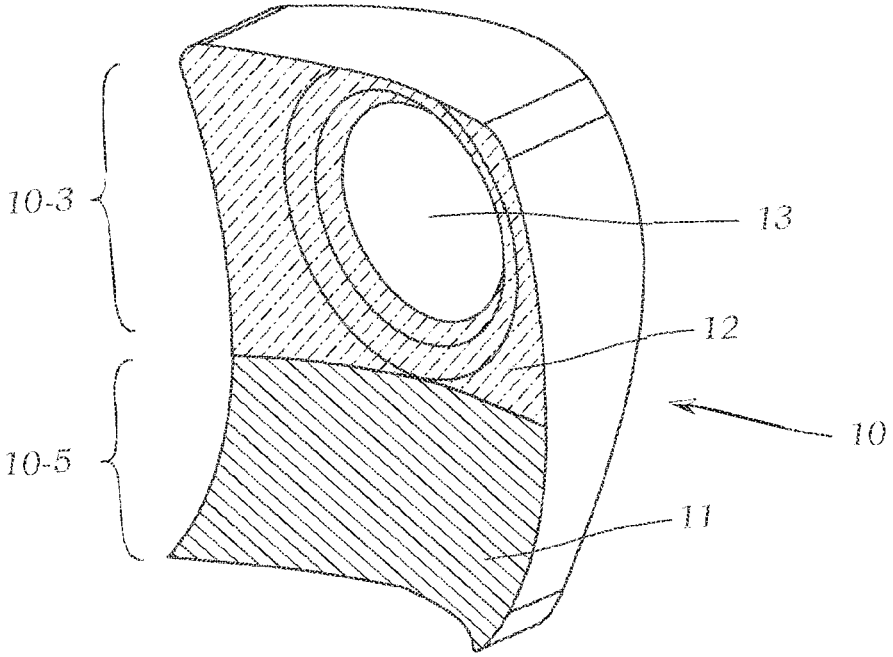
FIG. 4 shows a perspective representation of a configuration according to the invention of the mirror and the lens as a lens/mirror block.

It is also apparent, hereafter and from FIG. 4 which shows an embodiment of a lens/mirror block 10, that a reflective coating 11, for example a highly reflective Ag or Al coating, is applied to the surface area of the lens/mirror block 10 facing the light source 2 in the mirror area 10-5. According to the embodiment of FIG. 4, the lens area 10-3 furthermore includes a diaphragm coating 12, which leaves only a circular passage area 13 for light exposed so as to avoid extraneous light reducing the contrast. Advantageously, this diaphragm coating 12 can be made of the same material as the reflective coating. In a further advantageous embodiment, the diaphragm coating can be made of a material absorbing visible light, which is applied, for example, by way of a two-component injection molding technique or another coating process.

In a preferred and shown embodiment, the surface area of the lens/mirror block 10 facing the light source, which can also be referred to as the inner side, has a substantially concave shape, while the surface area facing away or outer side has a convex shape. However, all surface areas can also be designed differently, such as planar, convex or concave, depending on the particular lighting requirements. This depends, in particular, on further optical elements (lenses) possibly used in the module 1.

Figure 5:
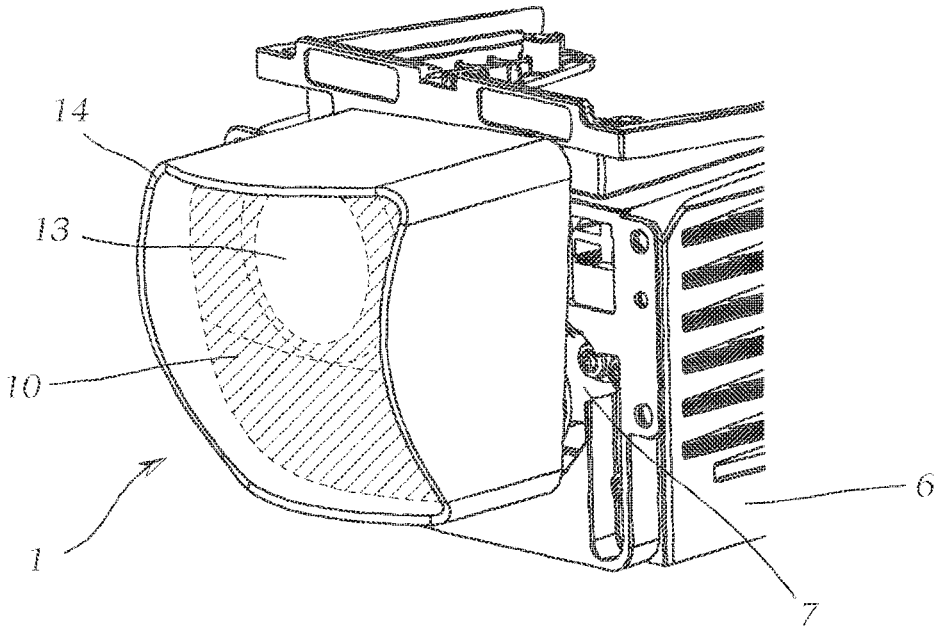
FIG. 5 shows a perspective representation obliquely from the front of a headlight module according to the invention, comprising a lens/mirror block covered by a panel.
Figure 6:
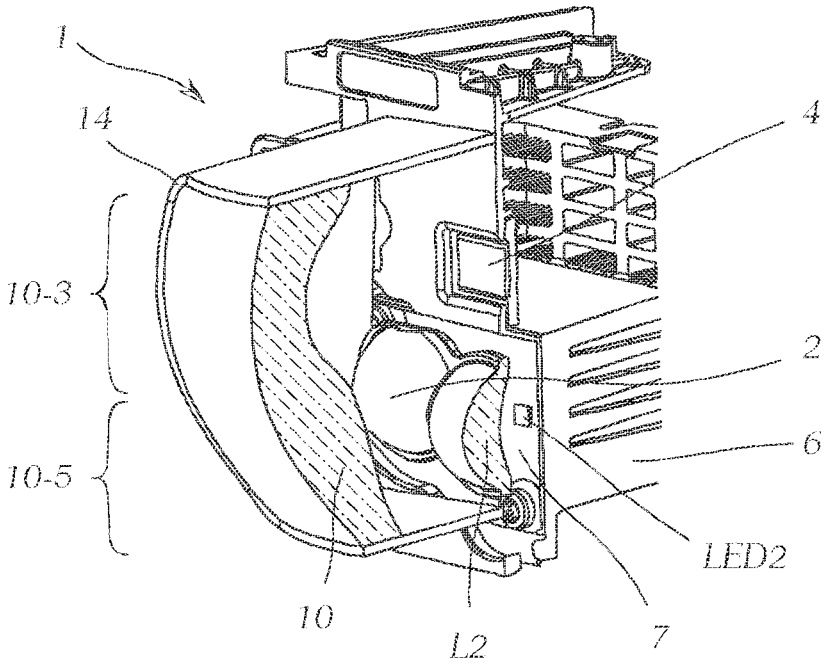
FIG. 6 shows the headlight module of FIG. 5, but in a partially cut view.

FIGS. 5 and 6 show the basic design shown in FIG. 3 in an application in a technical embodiment of a headlight module 1 according to the invention, wherein identical elements are denoted by identical reference numerals as in preceding figures and not necessarily described again to simplify matters. In any case, the lens/mirror block 10 is apparent here, in which the entire rear side, with the exception of the passage area 13, is provided with a reflective coating 11, for example, with an Ag coating. In this embodiment, the mirror coating 11 extending further toward the top thus also serves as the diaphragm coating. FIG. 5 is illustrated so as to be able to recognize the rear side of the lens/mirror block 10 from the front.

Furthermore, a slender panel 14, which covers the lens/mirror block 10 all the way around, that is, on the sides and at the top and bottom, and was configured in accordance with design specifications, is apparent in FIGS. 5 and 6.

Figure 7:
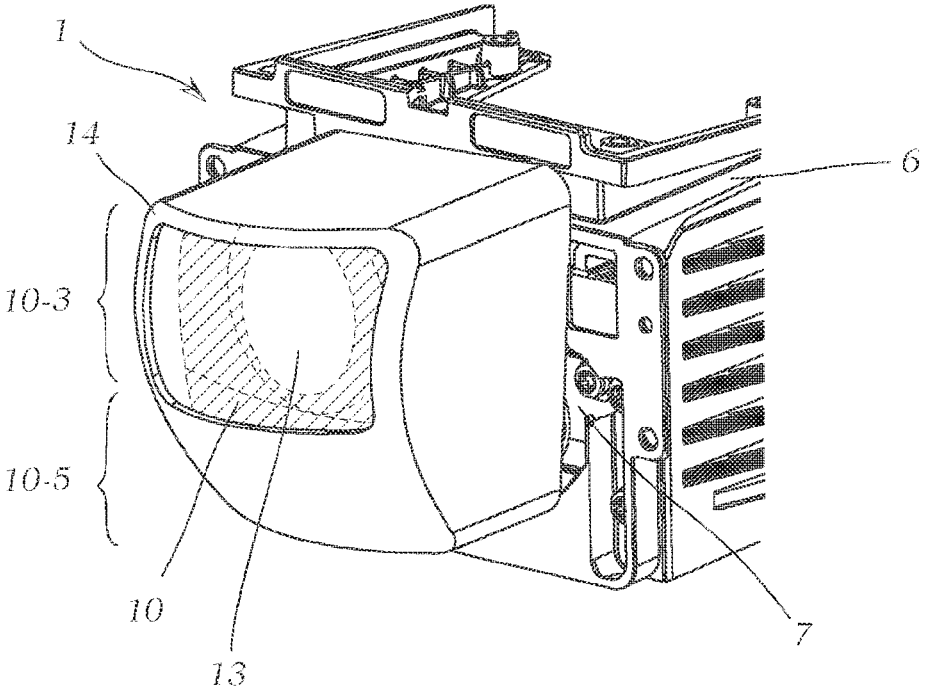
FIG. 7, in a representation similar to that of FIG. 6, shows a headlight module according to the invention comprising a different embodiment of the panel.

The embodiment according to FIG. 7 differs from that according to FIGS. 5 and 6 in that the panel 14 also covers the mirror area 10-5 of the lens/mirror block 10 at the front here, so that only the lens area 10-3 is not covered, which is not necessary, of course, because of the light emission.

The lens or the lens area 10-3 can either form the front termination of the headlight, or it may also be protected by a cover glass toward the front. Likewise, an additional lens system, which can optionally be integrated into the cover glass, can be arranged downstream of the lens, and it is also possible for further optical elements to be arranged between the light source and the lens/mirror block. Outside the areas of the lens/mirror block 10 that are relevant for lighting purposes, the lens/mirror block can be freely configured in accordance with design specifications or mechanical requirements, for example with respect to the mounting in the module.

| List of Reference Numerals | |
|---|---|
| 1 | headlight module |
| 2 | light source |
| 3 | mirror |
| 4 | micromirror array |
| 5 | lens |
| 6 | base body |
| 7 | circuit board |
| 8 | mirror mount |
| 9 | holder |
| 10 | lens/mirror block |
| 10-3 | lens area |
| 10-5 | mirror area |
| 11 | reflective coating |
| 12 | diaphragm coating |
| 13 | passage area |
| 14 | panel |
| 15 | beam path |
| LED 1, 2, 3 | laser diode, LED chip |
| L1, 2, 3 | focusing lens |

The invention claimed is:

1. A headlight module for motor vehicles, the headlight module comprising:

at least one light source;

at least one deflection mirror, a micromirror array activated by a control system, and a lens, wherein light emitted by the at least one light source is reflected via the at least one deflection mirror onto the micromirror array, and wherein a light pattern produced on the micromirror array is directed to the lens and is projected into traffic space via the lens as a lighting pattern; and a lens/mirror block formed in one piece comprising the lens in a lens area and the at least one deflection mirror in a mirror area, wherein the mirror area comprises a reflective coating on a first surface of the lens/mirror block facing the at least one light source, wherein the lens area comprises a diaphragm coating defining a light passage area on a second surface of the lens/mirror block facing the micromirror array, and wherein the first surface of the lens/mirror block is adjacent to the second surface of the lens/mirror block, and the first surface and the second surface together form a concave surface of the lens/mirror block.

2. The headlight module according to claim 1, wherein at least one further lens system is arranged downstream of the lens area (10-3).

3. The headlight module according to claim 1, wherein the at least one light source (2) comprises at least one laser diode/LED and a focusing lens (L1, L2, L3) arranged downstream thereof.

4. A motor vehicle headlight, comprising at least one headlight module (1) according to claim 1.

* * * * *